US005599515A

United States Patent [19]

Misra et al.

[11] Patent Number: 5,599,515

[45] Date of Patent: Feb. 4, 1997

[54] METHOD OF REMOVING MERCURY FROM SOLUTION

[75] Inventors: Manoranjan Misra, Reno; Jerry A. Lorengo, Elko, both of Nev.

[73] Assignee: Board of Regents of the University and Community College System of Nevada, Reno, Nev.

[21] Appl. No.: 424,997

[22] Filed: Apr. 19, 1995

[51] Int. Cl.[6] ..... C22B 43/00

[52] U.S. Cl. ..... 423/101

[58] Field of Search ..... 423/101, 29

[56] References Cited

U.S. PATENT DOCUMENTS

| | | | |
|---|---|---|---|
| 1,952,976 | 3/1934 | Dowsett et al. | 423/29 |
| 3,561,946 | 2/1971 | Braxton et al. | 71/70 |
| 4,133,755 | 1/1979 | Tarao et al. | 210/688 |
| 4,289,532 | 9/1981 | Matson et al. | 75/105 |
| 4,528,166 | 7/1985 | McDougall | 423/23 |
| 4,619,744 | 10/1986 | Horton | 204/105 R |
| 4,678,584 | 7/1987 | Elfline | 210/719 |
| 4,681,628 | 7/1987 | Griffin et al. | 75/118 R |
| 4,726,939 | 2/1988 | Touro | 423/101 |
| 4,731,187 | 3/1988 | Moriya et al. | 210/912 |
| 4,734,270 | 3/1988 | Touro et al. | 423/29 |
| 4,957,634 | 9/1990 | Bowers, Jr. et al. | 423/561.1 |
| 5,342,449 | 8/1994 | Holbein et al. | 423/109 |
| 5,372,726 | 12/1994 | Straten | 423/351 |

FOREIGN PATENT DOCUMENTS

| | | | |
|---|---|---|---|
| 0116989 | 8/1984 | European Pat. Off. | 423/101 |

OTHER PUBLICATIONS

Bond, A. M. et al., "Electrochemical Investigation of Kinetic and Thermodynamic Aspects of Oxidation and Reduction of Mononuclear and Binuclear Rhodium Dithiocarbamate and Diselenocarbamate Complexes," Inorg. Chem. (1989) 28:54–59, no month.

Diaz, X. et al., "Selective Solvent Extraction of Gold from Mercury in Concentrated Alkaline Cyanide Solutions," Minerals, Metals and Materials Soc. (1993) 245–257 EPD Congress 1993, no month.

Galvez, J. et al., "Catalytic Hydrogen Wave in Presence of Dimethyldithiocarbamate and Cobalt II," Electrochemical Acta (1984) 29:253–256, no month.

Ibrado, A. S. and Fuerstenau, D. W., "Adsorption of the Cyano Complexes of Ag(1), Cu(I), Hg(II), Cd(II) and Zn(II) on Activated Carbon," Minerals and Metallurgical Processing (Feb. 1989) pp. 23–28.

Leja, J., "Flotation Surfactants," Surface Chemistry of Froth Flotation (1982) Plenum Press, New York, pp. 258–259, no month.

Marsden, J. and House, I., "The Chemistry of Gold Extraction (Great Britain, Ellis Horwood Limited)", 1992, p. 397, no month.

Miertus, S. and Vladimir, F., "Theoretical study of the electron structure and properties of dithiocarbamates and their complexes with transition metals," Collect. Czech. Chem. Commun. (1984) 49:2744–2750. no month.

Miller, J. D. et al., "Technical Solutions for Pollution Prevention in the Mining & Mineral Processing Industries," Proceedings of the Engineering Foundation (Jan. 1995) 1–15.

Porcella, D., "Mercury in the Environment: Biogeochemistry," *Mercury Pollution, Integration and Synthesis,* (C. Watras, J. Huckabee, Eds.) USA, Lewis Publisher, (1994) pp. 3–19, no month.

(List continued on next page.)

*Primary Examiner*—Steven Bos

*Attorney, Agent, or Firm*—Greenlee, Winner and Sullivan, P.C.

[57] ABSTRACT

A method for selectively removing mercury from solutions, preferably solutions containing gold, such as gold cyanidation solutions, is provided comprising treating the solutions with dialkyldithiocarbamates, preferably potassium dimethyldithiocarbamate, to form stable mercury carbamate precipitates.

16 Claims, 5 Drawing Sheets

OTHER PUBLICATIONS

Sandberg, R. G. et al., "Calcium Sulfide Precipitation of Mercury During Cyanide Leaching of Gold Ores," (1984), RI 8907, USBM, no month.

Staker, W. L. and Sandberg, R. G., "Selective Elution of Mercury, Silver and Gold from Strong–Base Anion Exchange Resins," (1986) RI9093, USBM, no month.

Staker, W. L. et al., "Mercury Removal from Gold Cyanide Leach Solutions," *Gold and Silver: Heap and Dump Leaching Practice,* 1984, pp. 119–127, no month.

Wan, Q. et al., "High–Performance Liquid Chromatographic Determination of Aliphatic Secondary Amines as Mercury (II) Chelates," Chem Abstracts (1986) vol. 105, No. 53850v, no month.

Sharpe, A. G., "The Chemistry of Cyano Complexes of the Transition Metals," Academic Press Inc. (London) Ltd. (1976) pp. 291–299, no month.

Chem. Abstract 106:89575, Snukiskis, J, et al, Liet. TSR Mokslu Akad. Darb., Ser. B(5), pp. 46–51, 1986, no month.

METHOD OF REMOVING MERCURY FROM SOLUTION

FIELD OF THE INVENTION

This invention is in the field of mining recovery and cleanup processing, and specifically provides a method for precipitating mercury from processing solutions, particularly cyanide-containing processing solutions used for recovery of gold from its ores.

BACKGROUND OF THE INVENTION

Although the annual production of gold in the United States has been increasing steadily, oxide gold ore reserves are rapidly diminishing. In this regard, more complex ores, including refractory gold ores and low-grade ores, are being processed. In many cases, these resources contain significant amounts of mercury along with the gold values. Generally, the extraction of gold is accomplished by cyanidation in which leaching occurs by the addition of cyanide at alkaline pH. Cyanide, which is a strong lixiviant for gold, is an equally strong lixiviant for mercury. According to Sharpe (Sharpe, A. G., "The Chemistry of Cyano Complexes of the Transition Metals," (London Academic Press) 1976), simple and complex cyanides of mercury are restricted to the oxidation state of 2 and dissolve as the $Hg(CN)_{2^{\circ}}$, and $HG(CN)_3^{-1}$ and $HG(CN)_4^{-2}$ complexes of mercury.

Typically mercury (II) is released as cyano complexes during leaching and follows gold through the solution concentration and purification steps. Purification is done by carbon adsorption (Ibrada, A. S. and Fuerstenau, D. W., "Adsorption of the Cyano Complexes of Ag(I), Cu(I), Hg(II), Cd(II) and Zn(II) on Activated Carbon," Minerals and Metallurgical Processing (Feb. 1989) pp. 23–28) and electrowinning or zinc cementation (Sandberg, R. G. et al., "Calcium Sulfide Precipitation of Mercury During Cyanide Leaching of Gold Ores," (1984), RI8907, USBM).

In a typical cyanidization carbon-in-pulp (CIP) process (Sandberg, R. G., et al. (1984) "Calcium Sulfide Precipitation of Mercury During Cyanide Leaching of Gold Ores," RI 8907 USBM), the ore is ground with lime, adding water to form a slurry, and sodium cyanide is added to solubilize the gold. The mixture is thickened using various methods of flocculation, and the underflow is treated with calcium sulfide to precipitate mercury as HgS. The slurry is then exposed to activated carbon to adsorb gold and silver. Mercury is also adsorbed onto the carbon and interferes with gold and silver recovery. Precipitated mercury sulfide reports with tailings where it forms a disposal problem. U.S. Pat. No. 4,289,532 to Matson et al. also discloses a typical gold cyanidation process.

The overflow from the thickening process may also be subjected to mercury precipitation and filtration to recover mercury sulfide, and the filtrate exposed to activated carbon for removal of gold, silver and unprecipitated mercury. The loaded carbon streams exiting from the activated carbon treatments are stripped using a concentrated heated caustic cyanide strip solution and gold and silver recovered by electrowinning. The presence of mercury during exposure to activated carbon also interferes with recovery of the precious metals.

The presence of mercury in all steps of cyanidation poses a threat to both the environment and to the health of the plant workers. The presence of high concentrations of mercury (>50 g/t) has been shown to reduce significantly the efficiency of gold cementation with zinc (Marsden, J. and House, I., "The Chemistry of Gold Extraction (Great Britain, Ellis Horwood Limited), 1992, p. 397). Mercury vapor can be released during carbon stripping, carbon regeneration, electrowinning, and retorting (Staker, W. L. et al., "Mercury Removal from Cold Cyanide Leach Solutions," *Gold and Silver: Heap and Dump Leaching Practice,* 1984, p. 119). Further, in the CIP process, mercury builds up in the recycled leach solutions and reports to the tailings because only part of the mercury is adsorbed on carbon in the loading circuit (Sandberg, R. G. et al., "Calcium Sulfide Precipitation of Mercury During Cyanide Leaching of Gold Ores," RI 8907 USBM, 1984) Thus the tailings impoundment can . also represent an environmental concern.

Inorganic mercury can be transformed into methylmercury and dimethylmercury by the action of microorganisms under aerobic conditions and is favored by alkaline conditions. These compounds are volatile and can be released to the atmosphere (Organization for Economic Cooperation and Development, "Mercury and the Environment: Studies of Mercury Use, Emission, Biological Impact and Control," (Organization for Economic CoOperation and Development, Paris) 1974, p. 37). Furthermore, the methylation of mercury by sulfide reducing bacteria, producing a form of mercury that is more toxic and biologically available to biota, has been demonstrated (Porcella, D., "Mercury in the Environment: Biogeochemistry," *Mercury Pollution, Integration and Synthesis*, (C. Watras, J. Huckabee, Eds.) U.S.A., Lewis Publisher, (1994) p. 3).

It is evident that the problem of mercury in the cyanidation of gold and silver ores is a two-fold problem involving: (1) the presence, and possible volatization of mercury from post-leaching process streams which presents environmental and health problems; and (2) the presence of mercury, in its various forms, within the tailings impoundment and recycled process water. Methods to control mercury during gold cyanidation are of particular interest to the gold mining industry. In this regard, a number of different chemical processes for mercury control have been devised. These include precipitation, adsorption, solvent extraction, ion exchange and cementation. For example mercury may be selectively removed from solution by ion exchange resins (Staker, W. L. and Sandberg, R. G., "Selective Elution of Mercury, Silver and Gold from Strong-Base Anion Exchange Resins," (1986) RI9093, USBM). Solvent extraction has also been used (Diaz, X. et al., "Selective Solvent Extraction of Gold from Mercury in Concentrated Alkaline Cyanide Solutions," Minerals, Metals and Materials Soc. (1993) 245–257 EPD Congress 1993, 1992). Flocculating agents may be used to enhance mercury removal (U.S. Pat. No. 4,726,939 issued Feb. 23, 1988 to Touro for "Process for the Removal of Mercury from Precious Metal-Cyanide Liquors"). Another method of precipitating mercury from cyanide leach solutions involves the use of polysulfides such as calcium polysulfide. Although information is limited on the chemistry and mercury-precipitating potential of polysulfides, they have been used in at least one commercial application. Ultimately, prior to the production of ore metal, elemental mercury is removed by retorting.

Organic compounds such as water-soluble polymers recover mercury and other heavy metals from solution (U.S. Pat. No. 4,619,744 issued Oct. 28, 1986 to Horton for "Recovery of Heavy Metals from Aqueous Solutions"). Trithiocarbanates have also been used for this purpose (U.S. Pat. No. 4,678,584 issued Jul. 7, 1987 to Elfine for "Method of Removing Heavy Metal From Wastewater Streams"). Thiourea has been used to recover gold and mercury from solution (U.S. Pat. No. 4,681,628 issued Jul. 21, 1987 to Griffin et al. for "Gold Recovery Process"). None of these processes are selective for the recovery of mercury from solutions also containing gold.

Selective stabilization and/or removal of mercury has been accomplished by precipitation with inorganic sulfides (U.S. Pat. No. 4,734,270 issued Mar. 29, 1988 to Touro for "Sulfide Treatment to Inhibit Mercury Adsorption onto Activated Carbon in Carbon-in-Pulp Gold Recovery Circuits"). The gold cyanide complex is stable with respect to sulfide precipitation in alkaline cyanide solutions and on this basis a selective separation is possible. Studies have been reported using $H_2S$, $Ag_2S$, FeS, $Na_2S$, and CaS. Sandberg et al. at the U.S. Bureau of Mines in Salt Lake City, Utah have reported on mercury precipitation from gold cyanide leach solutions with CaS and $Na_2S$ (Sandberg, R. G. et al. (1984), "Calcium Sulfide Precipitation of Mercury During Cyanide Leaching of Gold Ores," RI 8907 USBM; Staker, W. L. and Sandberg, R. G. (1986), "Calcium Sulfide Precipitation of Mercury for gold-Silver Leach Slurries," RI 9042, USBM). They found that $Na_2S$ and CaS can serve as precipitants for mercury but report that redissolution of mercury occurs when $Na_2S$ is used. Calcium sulfide, on the other hand, is reported to minimize the rate of mercury redissolution but, like all other sulfides, tends to precipitate silver from solution as well.

Known methods of removal of mercury from process solutions suffer from one drawback or another. For example, the ion exchange resins are expensive and not very selective. The use of cementation by addition of noble metals has a detrimental effect and also contributes to gold loss. Selective solvent extraction using dibutylbutylphosphonate is unsatisfactory because it applies to strip solutions prior to the electrowinning circuit. In this case the mercury has already had a chance to volatize during the stripping and carbon regeneration circuit.

The only feasible known method for mercury recovery from gold cyanide circuits is the use of CaS and $Na_2S$. $H_2S$, AgS and FeS can also be used, but $H_2S$ is not recommended due to its high toxicity, while the use of FeS would form ferrocyanide in leach solutions, tying up vast amounts of cyanide, such that its use would be prohibitively expensive (Sandberg, R. G. et al., "Calcium Sulfide Precipitation of Mercury During Cyanide Leaching of Gold Ores," RI 8907 USBM, 1984). AgS would also not be economical to use due to its costly silver component. However, the sulfides of HgS tend to resolubilize in cyanide solution after a few hours and are not stable at high cyanide concentration. CaS and $Na_2S$ are able to precipitate mercury only from the $Hg(CN)_4^{-2}$ complex and cannot efficiently precipitate it from the dicyano complex, $Hg(CN)_2$. Moreover, mercury redissolves when $Na_2S$ is used, probably due to the fact that $Na_2S$ is useful only in a limited pH range below 10 in which cyanide tends to dissociate into HCN. CaS is reported to minimize the rate of mercury redissolution but, like all other sulfides, tends to precipitate silver from solution as well. (However it was found that the addition of copper into solution deters silver precipitation while having no effect on the mercury precipitation rate (Staker, W. L. and Sandberg, R. G., "Calcium Sulfide Precipitation of Mercury from Gold-Silver-Leach Slurries," (1986) RI9042, USBM)).

A method is needed to selectively remove mercury from process solutions, particularly cyanide-containing solutions also containing gold and silver, as found in gold recovery processes, such that the mercury does not redissolve in the solution.

Dialkyldithiocarbamates are known to the art and potassium dimethyldithiocarbamate is known to form insoluble metallic salts except with those elements of the alkali and alkaline earth families (Leja, J., "Flotation Surfactants," Surface Chemistry of Froth Flotation (1982) Plenum Press, New York, pp. 258–259). Complexes formed between these compounds and various metals are also known (Galvez, J. et al., "Catalytic Hydrogen Wave in Presence of Dimethyldithiocarbamate and Cobalt II," Electrochemical Acta (1984) 29:253–256; Bond, A. M. et al., "Electrochemical Investigation of Kinetic and Thermodynamic Aspects of Oxidation and Reduction of Mononuclear and Binuclear Rhodium Dithiocarbamate and Diselenocarbamate Complexes," Inorg. Chem. (1989) 28:54–59; Stanislav, M. and Vladimir, F., "Theoretical study of the electron structure and properties of dithiocarbamates and their complexes with transition metals," Collect. Czech Chem. Commun. (1984) 49:2744–2750, Chem. Abstracts 1985 Vol. 102, No. 100934a). Mercury complexes with such organic compounds have been mentioned in the literature (Wan, Q. et al., "High-Performance Liquid Chromatographic Determination of Aliphatic Secondary Amines as Mercury (II) Chelates," Chem Abstracts (1986) Vol. 105, No. 53850v). U.S. Pat. No. 3,561,946 issued Feb. 9, 1971 to Braxton et al. discloses inter alia alkyl mercury complexes with dimethyldithiocarbamate as useful herbitoxic compositions.

All patents and publications mentioned herein are incorporated by reference.

SUMMARY OF THE INVENTION

A method is provided for removing mercury from solutions containing mercury in solution, preferably cyanide solution, comprising contacting the solution with a carbamate precipitating agent having the formula:

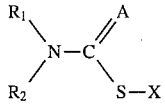

I where $R_1$ and $R_2$ are independently $C_1$–$C_4$ alkyl, branched alkyl or alkenyl; A is S or O; and X is sodium or potassium.

$R_1$ and $R_2$ are preferably ethyl or methyl, most preferably methyl. A is preferably sulfur, and X is preferably potassium. The most preferred compound for use in this invention is dimethyldithiocarbamate:

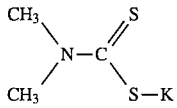

II

These carbamate compositions are able to precipitate mercury from $Hg(CN)_4^{-2}$, $Hg(CN)^{3-1}$ and $Hg(CN)_2^0$ in solution to form a stable precipitate.

The methods are especially useful in removing mercury from process solutions in gold cyanide processes for recovering gold metal from ore, as the carbamate selectively removes mercury without removing gold.

The process solution treated may be the primary cyanide leach solution prior to contact with activated carbon, and/or other process streams such as thickener overflow streams, tailings solutions, and streams entering the electrowinning circuit.

Very small amounts of the carbamate precipitating agent are required. For treatment of typical low-grade ores containing about 0.5 lb/ton mercury, approximately 0.5 to 2 lb/ton and preferably about 0.5 to 1 lb/ton of the carbamate is required.

In typical process solutions having mercury concentrations of about 200 ppb, mercury is removed using the carbamates and processes of this invention to below the detection level of 1 ppb.

In the process of this invention, the mercury-containing solution is contacted with carbamate by adding it directly to the solution with slow agitation to precipitate mercury.

DETAILED DESCRIPTION OF THE PREFERRED EMBODIMENTS

The carbamate compounds of Formula I are useful for forming stable precipitates of mercury, thus removing it from solution. These carbamates, also known as thiol surfactants, form compounds of mercury with far greater stability than HgS. The carbamates also have the ability to precipitate both the dicyano and tetracyano complexes of mercury $(HgCN)_2$ and $Hg(CN)^{4-2}$, respectively), while $Na_2S$ and CaS are able to efficiently precipitate only the tetracyano complex, and not the more stable dicyano mercury complex.

Potassium dimethyldithiocarbamate forms extremely insoluble metallic salts which are very massive and dense particles. An example of the reaction is shown below:

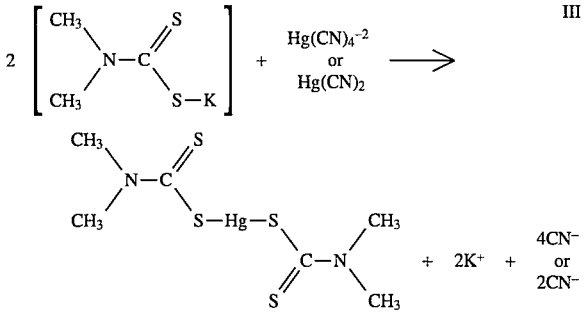

III

Mercury forms complexes with the other carbamates of Formula I by analogous reactions.

Figure 2:
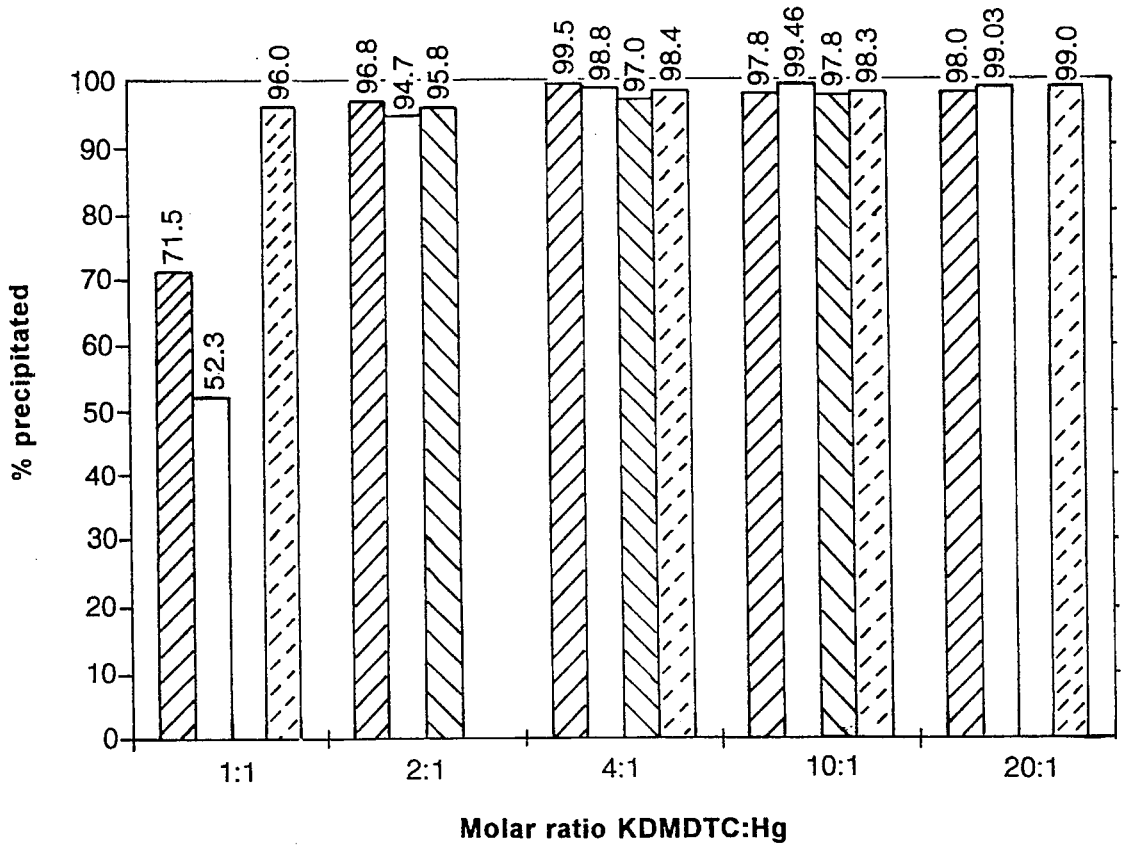
FIG. 2 shows precipitation and removal of dicyano and tetracyano complexes of mercury from solution using dimethyldithio-carbamate at varying ratios of carbamate to mercury. From dark to light, the bars indicate: Darkest= $Hg(CN)_2$ as determined by an independent laboratory; Second darkest=$Hg(CN)_2$ as determined by University of Nevada-Reno laboratory; Second lightest=$Hg(CN)_4^{-2}$ as determined by an independent laboratory; Lightest= $Hg(CN)_4^{-2}$ as determined by University of Nevada-Reno laboratory.

FIG. 2 illustrates the effectiveness of the methods of this invention to remove over 96% of both cyanomercury complexes at a molar ratio of mercury to dimethyldithiocarbamate of 1:2. Mercury can be stabilized by adding the carbamates of this invention during cyanidation without any detrimental effect on gold recovery.

Figure 1:
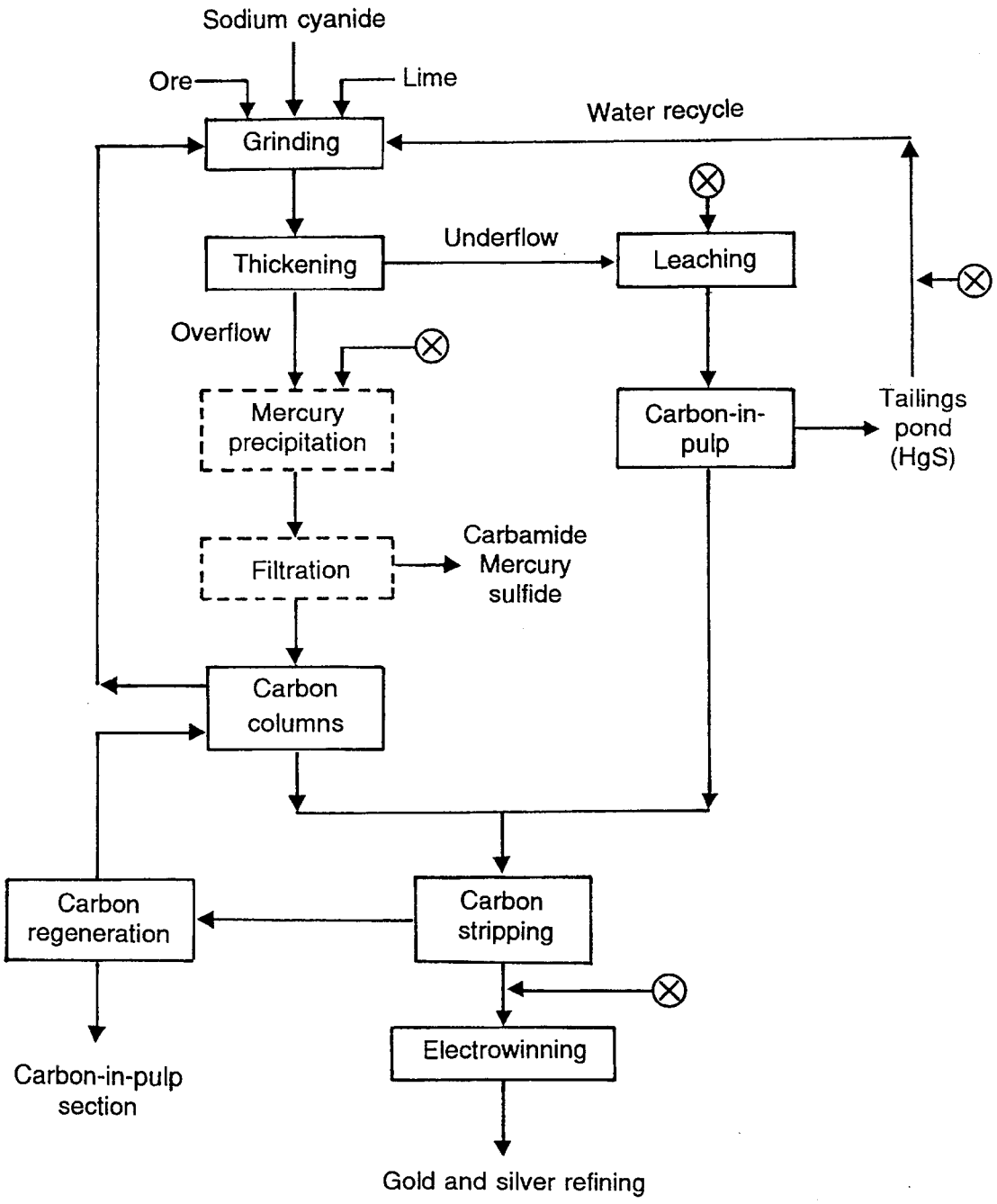
FIG. 1 shows a process circuit for a typical gold cyanidization process. Points on the circuit where mercury may be profitably removed from solution by addition of the carbamate compositions of this invention are marked Ⓧ.

FIG. 1 shows a typical gold cyanide leach process. Sodium cyanide is added to the ore along with lime and water including process recycle water from tailings. The ore is ground and thickened with flocculant. The underflow from the thickening process may be treated with the carbamates of Formula I, preferably potassium dimethyldithiocarbamate, to precipitate and stabilize mercury. The stream then enters the carbon-in-pulp circuit where gold and silver are adsorbed onto activated carbon. The mercury-carbamate complex is not adsorbed and reports to the tailings treatment circuit.

If the carbamate precipitation process has not been used during the leaching circuit, the tailings solution can be treated with carbamate to precipitate mercury. The carbamates may also be used to treat thickener overflow prior to filtration.

If the carbamate treatments have not previously been used, mercury will adsorb onto the carbon in both the carbon-in-pulp treatment of the leach solution and carbon column treatment of thickener overflow. After stripping of gold, silver and mercury from the carbon, carbamates can be added to the solution entering the electrowinning circuit to precipitate mercury. The mercury-carbamate complex can be separated from the solution by filtration, flotation, or settling.

Figure 3:
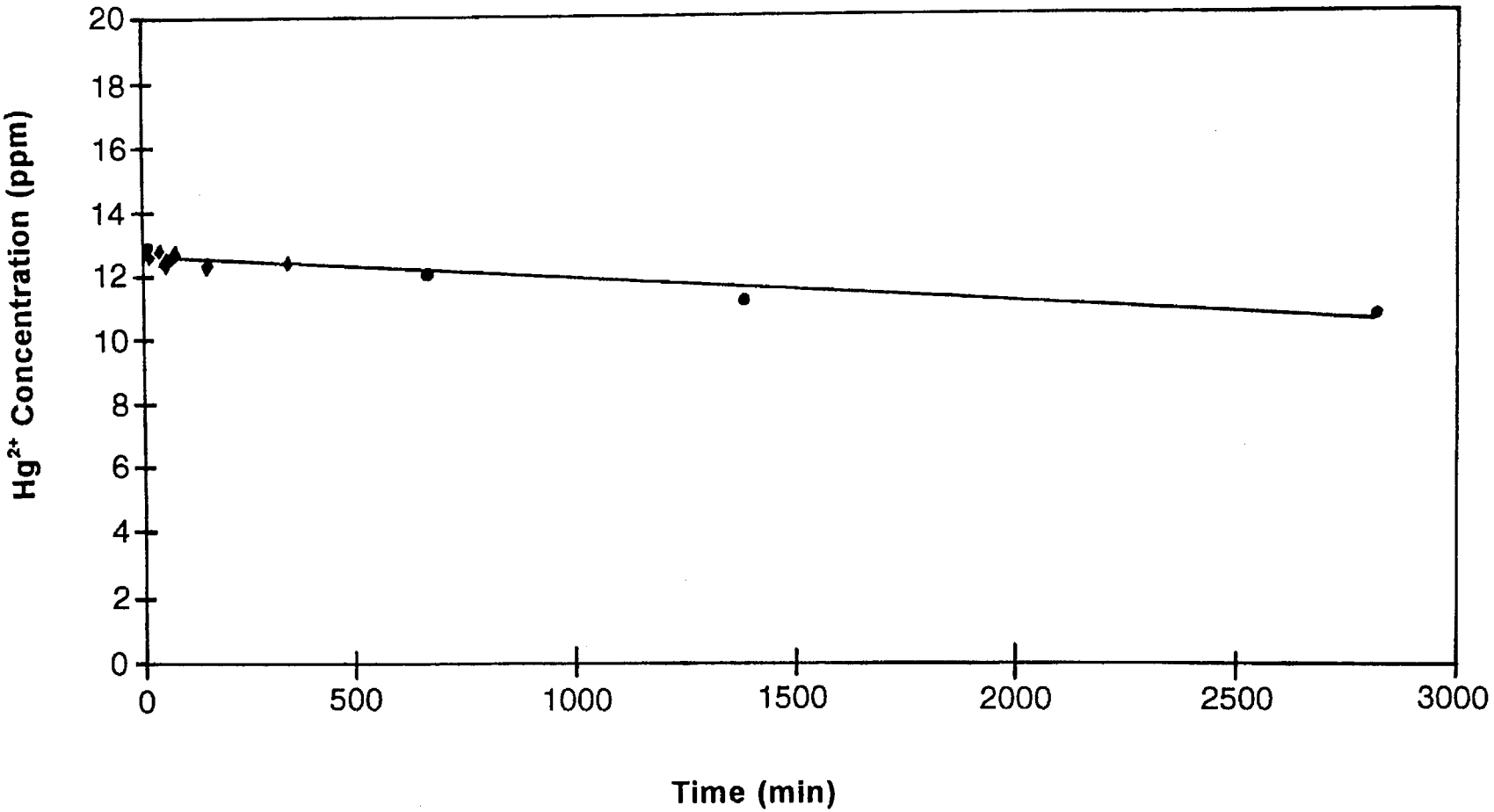
FIG. 3 illustrates the stability of the mercury dimethyldithiocarbamate precipitate, graphing $Hg^{+2}$ concentration (ppm) versus time for the carbamate complex formed from an original $Hg^{+2}$ solution having a concentration of 482 ppm resident in a 0.5 lb/ton cyanide (as NaCN) solution.

As shown in FIG. 2, a molar ratio of potassium dimethyldithiocarbamate to mercury of 2:1 is sufficient to precipitate most of the mercury present. The mercury-dimethyldithiocarbamate complex is stable for at least several days. FIG. 3 shows stability of this complex over a 50-hour period.

Figure 4:
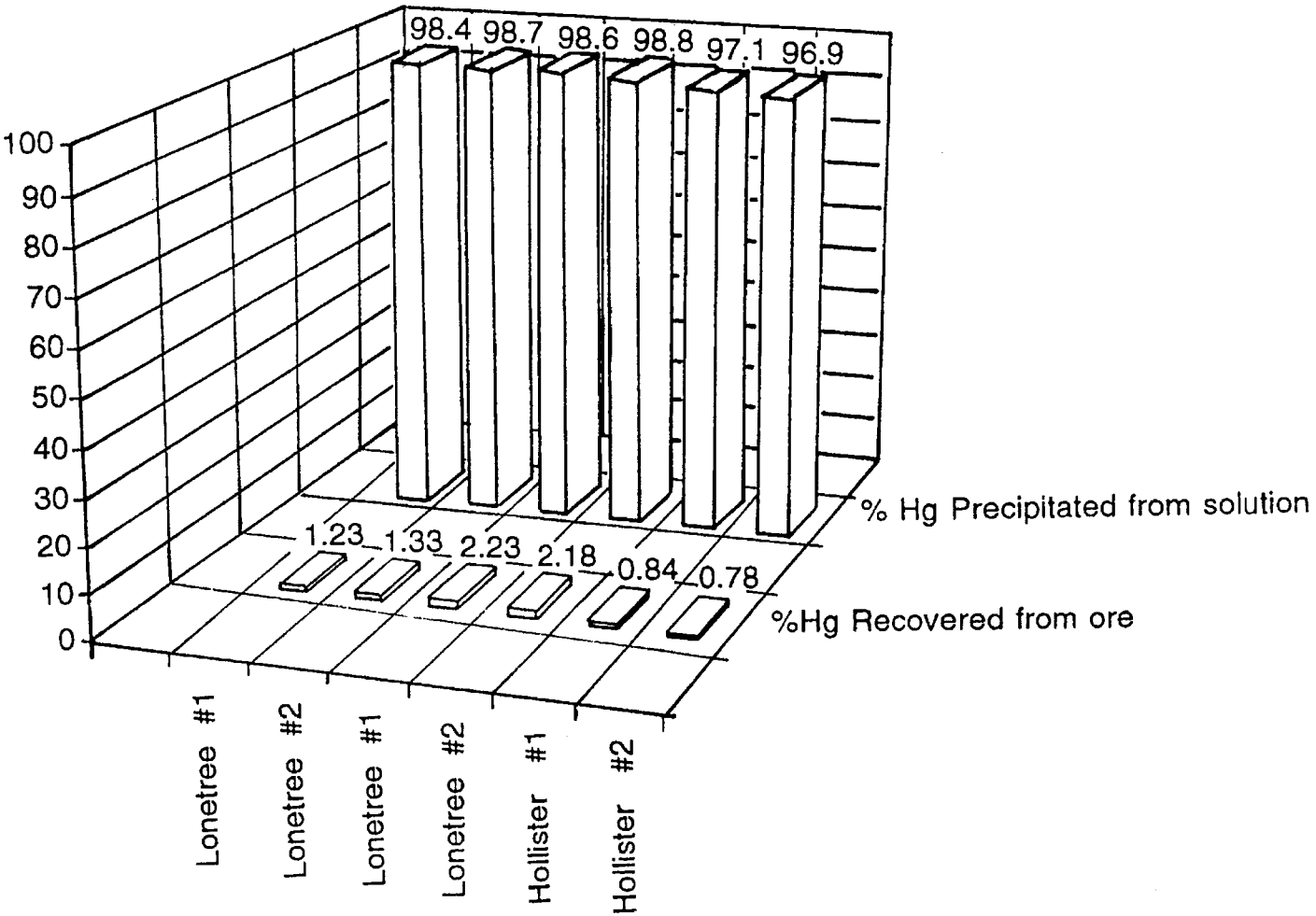
FIG. 4 illustrates the precipitation of mercury during cyanidation of two different gold ores by potassium dimethyldithiocarbamate.

The process of this invention removes mercury from typical gold ores. As shown in FIG. 4, potassium dimethyldithiocarbamate was used to precipitate mercury from cyanidation solutions of gold ores taken from Hollister and Lonetree mines. Note that more than 96% of the soluble mercury precipitated upon addition of the carbamate with cyanidation. Less than 1–2% of the original mercury is present as mercury cyanide in solution after precipitation. The carbamate was added in stoichiometric amounts in the range of 0.5 lb/ton of ore during cyanidation.

Figure 5:
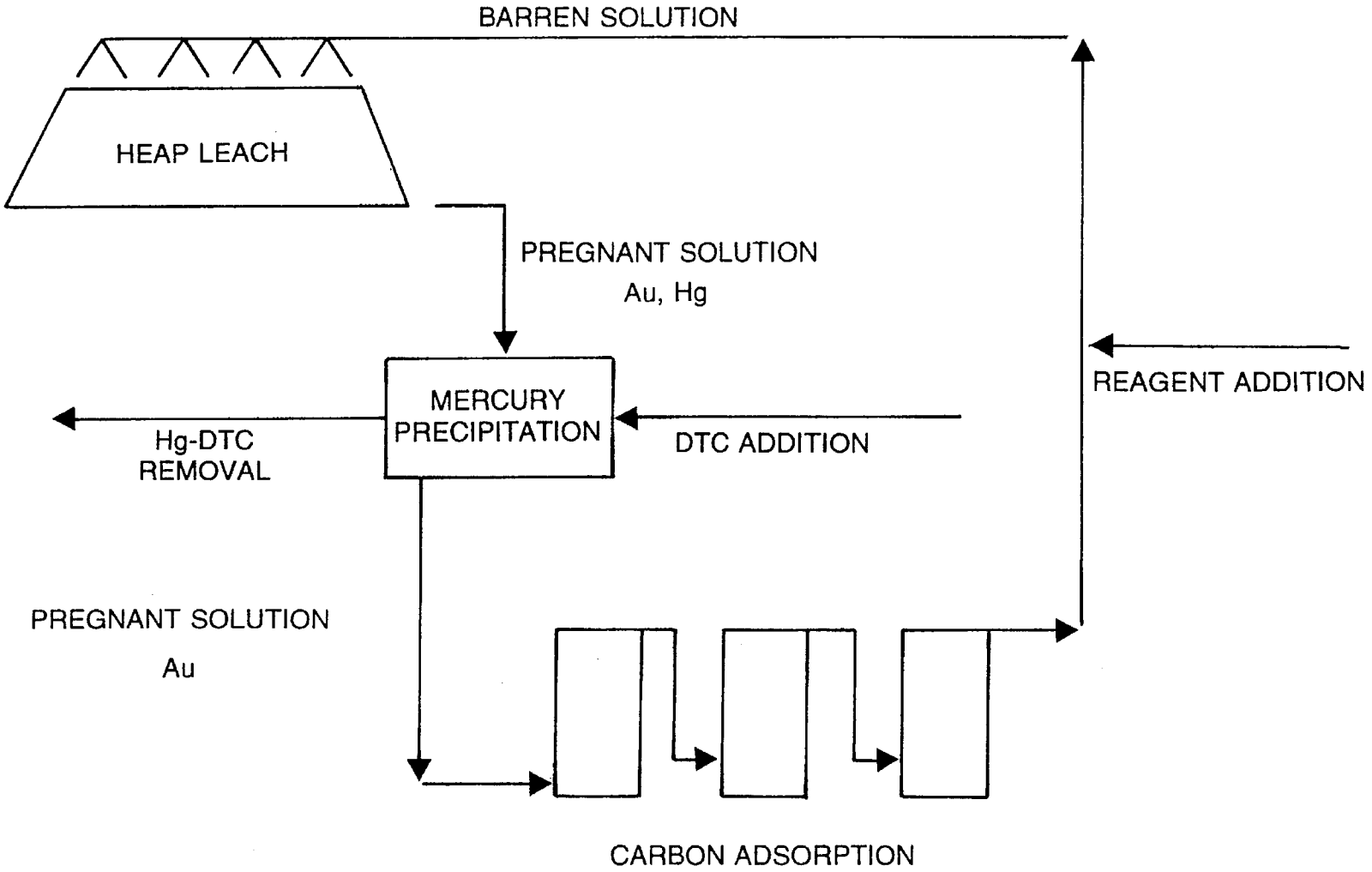
FIG. 5 illustrates another embodiment of the invention using carbamate to precipitate mercury cyanide and other mercury species from a typical gold heap leach operation.

The mercury precipitation process of this invention may also be used in heap leaching processes for gold recovery as shown in FIG. 5. The pregnant solution from the heap leaching process containing mercury cyanide in solution as well as gold is treated with carbamate to precipitate mercury-carbamate complex. After removal of the complex, the pregnant gold-containing solution is treated with activated carbon for gold adsorption, and the solution recycled.

The process of this invention is useful for removing mercury from solutions other than gold cyanidation solutions. Due to the stability of the mercury-cyanide complex, gold cyanidation solutions are one of the most difficult from which to remove mercury. Mercury may also be effectively removed from solutions in which it occurs as a halite, nitrate, sulfate, etc.

The pH of the solution should not be less than about 4 for effective precipitation of mercury by the processes of this invention. Preferably the pH is between about 8 and about 11, and most preferably about 10.

When heavy metals are present in the solution, such as copper, which compete with mercury for the carbamate in forming a stable complex for precipitation, excess carbamate may be added to exhaust the competing metal ions; alternatively, the pH of the solution may be adjusted, as will be readily apparent to those skilled in the art, to favor precipitation of the mercury complex. For example, copper carbamate will precipitate at pH 5, but not at pH 10.

Mercury-carbamate complexes may be separated from tailing streams and filtration residues by flotation or settling. Flotation of Hg-DTC precipitates can be readily accomplished. Mercury-carbamate complexes are extremely hydrophobic. They can be separated by flotation using a minimum amount of frother. On the contrary it is difficult to float HgS and also it is impossible to filter HgS. Experiments have shown that more than 99% of mercury-carbamate compounds can be floated using a tall laboratory column by injecting 0.2 liter air/minute with addition of a small amount of frother. No flotation of HgS can be accomplished under the same conditions.

The mercury-carbamate complex is safe for disposal because of its high stability.

EXAMPLES

Example 1

A solution was prepared by adding 0.48185 g $Hg(CN)_2$ to 1 liter of deionized water at a pH of approximately 11. The free cyanide concentration was maintained at approximately 0.5 lb/ton by adding 0.23543 g of NaCN to the mercury cyanide solution.

Mercury precipitation was then done by adding the stoichiometrically required amount of potassium dimethyldithiocarbamate (available from Buckman Laboratories, Memphis TN 38101 as BUSAN® 85) compound in order to precipitate the mercury from solution. The cyanide concentration in solution is roughly approximate to 0.5 lb/ton, a concentration typically used in actual (C.I.L.) cyanidation circuits. The precipitate was white to pale yellow.

After precipitation, 25 mL samples were taken while mixing at various time periods using a 0.2 μm filter. The filtrate samples were preserved using NaOH and refrigerated until analysis.

Results (FIG. 3) show that the dimethyldithiocarbamate compound is very stable at relatively high cyanide concentrations for an extended period of time.

Example 2

The above experiment was repeated using sodium dimethyldithiocarbamate (available from Buckman Laboratories as BUFLOC® 528) with similar results. The potassium complex appeared to be somewhat more effective as compared to the sodium complex.

Example 3

Solutions were prepared consisting of 25 ppm (mg/L) mercury as both $Hg(CN)_2$ and $Hg(CN)_4^{-2}$. $NaAu(CN)_2$ was also added to determine the ability of potassium dimethyldithiocarbamate and other organic compounds to selectively precipitate mercury. The organic compounds were tested by adding excess stoichiometric amounts of each and centrifuging. The organic compounds tested were the dithiophosphates AEROFLOAT® 208 (dithiophosphate), AEROFLOAT® 211 (dithiophosphate), AEROFLOAT® 238 (dithiophosphate), AEROFLOAT® 241 (ammonium dicresyldithiophosphate), AEROFLOAT® 242 (ammonium dicresyldithiophosphate), AERO® 404 (sodium disecbutyldithiophosphate 11%), AERO® 407 (dithiophosphate) and AERO® 3477 (dithiophosphate); and the dithiocarbamates BUSAN® 85 (potassium dimethyldithiocarbamate) and BUFLOC® 528 (sodium dimethyldithiocarbamate). Dithiophosphates have no mercury precipitating ability, while the carbamates were very effective.

The supernatants after centrifuging were tested using atomic absorption and cold vapor atomic absorption (CVAA) analysis. The precipitates were kept and deionized water added to each and the solution over each precipitate tested periodically for stability.

Example 4

To demonstrate that the carbamates selectively remove mercury from gold-containing solutions, potassium dimethyldithiocarbamate was added to the leach circuit in a cyanide leach process for a typical low-grade gold ore from central Nevada. Comparisons using no precipitating agent and using CaS were also done. The results are shown in Table 1.

TABLE 1

| Conditions | Gold Extraction | Mercury Extraction |
|---|---|---|
| Cyanide 1 lb/ton, pH:10 | 89% | 38% |
| Cyanide 1 lb/ton, pH:10, potassiumdimethyl-dithiocarbamate 10 lb/ton | 90% | <.50% |
| Cyanide 1 lb/ton, pH:10, CaS 18 lb/ton | 91% | 15% |

The foregoing examples are illustrative of the processes of this invention. As will be understood by those skilled in the art, process conditions and reagents can be varied resulting in embodiments within the scope of the appended claims.

We claim:

1. A method of selectively removing mercury from a solution also containing gold comprising contacting said solution with a precipitating agent having the formula:

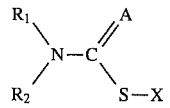

where $R_1$ and $R_2$ are independently, $C_1$–$C_4$ straight or branched alkyl or alkenyl, A is S or O, and X is K or Na, to form a mercury-carbamate precipitate.

2. The method of claim 1 wherein said solution comprises $Hg(CN)_4^{-2}$.

3. The method of claim 1 wherein said solution comprises $Hg(CN)_2$.

4. The method of claim 1 wherein $R_1$ and $R_2$ are methyl.

5. The method of claim 1 wherein $R_1$ and $R_2$ are ethyl.

6. The method of claim 1 wherein A is sulfur.

7. The method of claim 1 wherein X is potassium.

8. The method of claim 1 wherein $R_1$ and $R_2$ are independently methyl or ethyl, X is sodium or potassium, and A is sulfur.

9. The method of claim 1 wherein said solution is a cyanide leach solution of a process for extraction of gold from gold ore.

10. The method of claim 1 wherein said solution is an effluent from a carbon-in-pulp gold extraction process.

11. The method of claim 1 wherein said solution is a waste solution from a gold recovery process.

12. The method of claim 1 wherein said mercury-carbamate precipitate is separated from said solution by a settling process.

13. The method of claim 1 wherein said mercury-carbamate precipitate is separated from said solution by air flotation.

14. The method of claim 1 wherein the pH of said solution is greater than about 4.

15. The method of claim 1 wherein the pH of said solution is between about 8 and about 11.

16. A method for selectively removing mercury from a solution also containing gold comprising contacting said solution with potassium dimethyldithiocarbamate to precipitate said mercury.

* * * * *